US006354761B1

(12) United States Patent
Clements

(10) Patent No.: US 6,354,761 B1
(45) Date of Patent: Mar. 12, 2002

(54) TRUCK-MOUNTED ROLLER ASSEMBLY

(76) Inventor: Mark E. Clements, 3297 County Road 146, Cardington, OH (US) 43315

( * ) Notice: Subject to any disclaimer, the term of this patent is extended or adjusted under 35 U.S.C. 154(b) by 0 days.

(21) Appl. No.: 09/597,644

(22) Filed: Jun. 20, 2000

(51) Int. Cl.[7] ..... E01C 19/26

(52) U.S. Cl. ..... 404/129; 404/122; 404/128; 404/172; 404/684.5

(58) Field of Search ..... 404/122, 128, 404/129, 133.2, 102, 103; 37/231, 232, 234, 268; 172/684.5

(56) References Cited

U.S. PATENT DOCUMENTS

| | | | | | |
|---|---|---|---|---|---|
| 2,386,025 | A | | 10/1945 | Wills | |
| 2,962,950 | A | | 12/1960 | Martin | |
| 3,808,714 | A | * | 5/1974 | Reissinger et al. | 37/233 |
| 3,845,577 | A | * | 11/1974 | Naymik | 37/231 |
| 3,873,228 | A | * | 3/1975 | Dunham | 404/128 |
| 3,883,965 | A | * | 5/1975 | Poirier, Sr. et al. | 37/231 |
| 4,120,366 | A | * | 10/1978 | Nissen et al. | 172/805 |
| 4,269,535 | A | | 5/1981 | Schultz | |
| 4,307,523 | A | * | 12/1981 | Reissinger et al. | 37/233 |
| 4,369,590 | A | * | 1/1983 | Miller | 37/231 |
| 4,378,052 | A | * | 3/1983 | Anderson | 172/449 |
| 4,579,479 | A | | 4/1986 | Bryant | |
| 4,702,644 | A | | 10/1987 | Cioffi | |
| 4,911,248 | A | * | 3/1990 | Schrepfer | 172/464 |
| 5,114,269 | A | * | 5/1992 | Shepherd | 404/122 |
| 5,507,593 | A | | 4/1996 | Hollon | |
| 5,752,782 | A | | 5/1998 | Hulicsko | |
| 5,771,980 | A | * | 6/1998 | Mork | 172/501 |
| 5,860,764 | A | | 1/1999 | Roberts | |

FOREIGN PATENT DOCUMENTS

| | | | | |
|---|---|---|---|---|
| GB | 2238563 | A | * 5/1991 | E01H/1/08 |

* cited by examiner

*Primary Examiner*—David Bagnell
*Assistant Examiner*—Katherine W Mitchell
(74) *Attorney, Agent, or Firm*—Thomas S. Baker, Jr.

(57) ABSTRACT

A roller assembly, for use with a hydraulically-powered, truck-mounted, standard snowplow lift having three attach points, is provided with a rigid frame, a roller rotatably supported in the frame, a saddle bracket pivotally attached to the frame and to two of the snowplow lift attach points, and a tongue member also pivotally attached to the frame and to another one of the three snowplow lift attach points, the assembly frame being rotatable relative to the frame through a limited range to accommodate changes in curvature of a roadway surface.

6 Claims, 4 Drawing Sheets

TRUCK-MOUNTED ROLLER ASSEMBLY

CROSS-REFERENCES

None.

FIELD OF THE INVENTION

This invention relates generally to roadway maintenance equipment, and particularly concerns an improved roller assembly which may be utilized advantageously in connection with the patching of roadway surfaces with asphalt materials, and which also may be readily attached to a hydraulically-powered, three-attach point standard municipal snowplow lift mounted on a conventional roadway maintenance truck.

BACKGROUND OF THE INVENTION

A wide range of maintenance equipment is known to be available in the United States for use in connection with the maintenance of roadway surfaces using various asphaltic patching materials. U.S. Pat. No. 2,386,025 issued to Wills, for instance, discloses a hydraulically-powered truck-mounting to which either a castor-supported snowplow or a conventional roadway roller may be attached. The Wills equipment, however, does not provide for pivotal mounting to accommodate roadway transverse unevenness. U.S. Pat. No. 2,962,950 issued to Martin also discloses a truck and roller unit combination but without such transverse pivoting.

See also U.S. Pat. No. 4,269,535 granted to Schultz which discloses compactor equipment that is tractor-mounted rather than truck-mounted.

U.S. Pat. No. 4,579,479 granted to Bryant teaches equipment that has both a roadway patching material feed system and a co-operating roller but that operates independently of the truck that delivers the roadways patching material to the roadway maintenance site.

A detachable roller for mounting on a truck delivering roadway patching material is disclosed in U.S. Pat. No. 4,702,644 issued to Cioffi, and utilizes a pair of manually-controlled, roller end-position hydraulic actuators to effect transverse pivoting of the roller to accommodate roadway surface unevenness.

Other examples of equipment intended for use in roadway maintenance operations, but not necessarily for asphalt surface patching, include the roller assemblies of U.S. Pat. No. 5,507,593 granted to Hollon et al., U.S. Pat. No. 5,752,782 issued to Hulicsko, and U.S. Pat. No. 5,860,764 granted to Roberts.

I have invented a roller assembly that may be readily attached to, and detached from, the attach points of a standard hydraulically-controlled, truck front-end, three-attach point snowplow lift, that pivots laterally to accommodate changes in roadway surface transverse curvature, that is easy to raise and lower, and that may be conveniently loaded with transferred truck weight to develop added patching compression forces.

Other objects and advantages of the present invention will become apparent from a consideration of the various descriptions, drawings, and claims which follow.

SUMMARY OF THE INVENTION

The present invention is basically comprised of a roller frame having a generally rectangular planform and rotationally supporting a hollow cylindrical roller at its ends, an elongated tongue member that is pivotally connected to the roller frame and having a pivot attachment, and a saddle bracket pivotally connected to the roller frame, having a pair of spaced apart pivot attachments, and having connectors joining the saddle bracket to the roller frame with limited rotational movement of the roller frame relative to the saddle bracket. The tongue member pivot attachment and the saddle bracket pair of pivot attachments co-operate with respective attach points of a standard hydraulically-powered, front-end, three-point snowplow truck lift from which any previously installed snowplow has been removed. The three-point snowplow truck lift hydraulic controls may be selectively operated to raise or lower the attached roller assembly and to transfer truck weight onto the roller assembly to develop increased compression forces during roadway surface patching operations.

DETAILED DESCRIPTION

Figure 1:
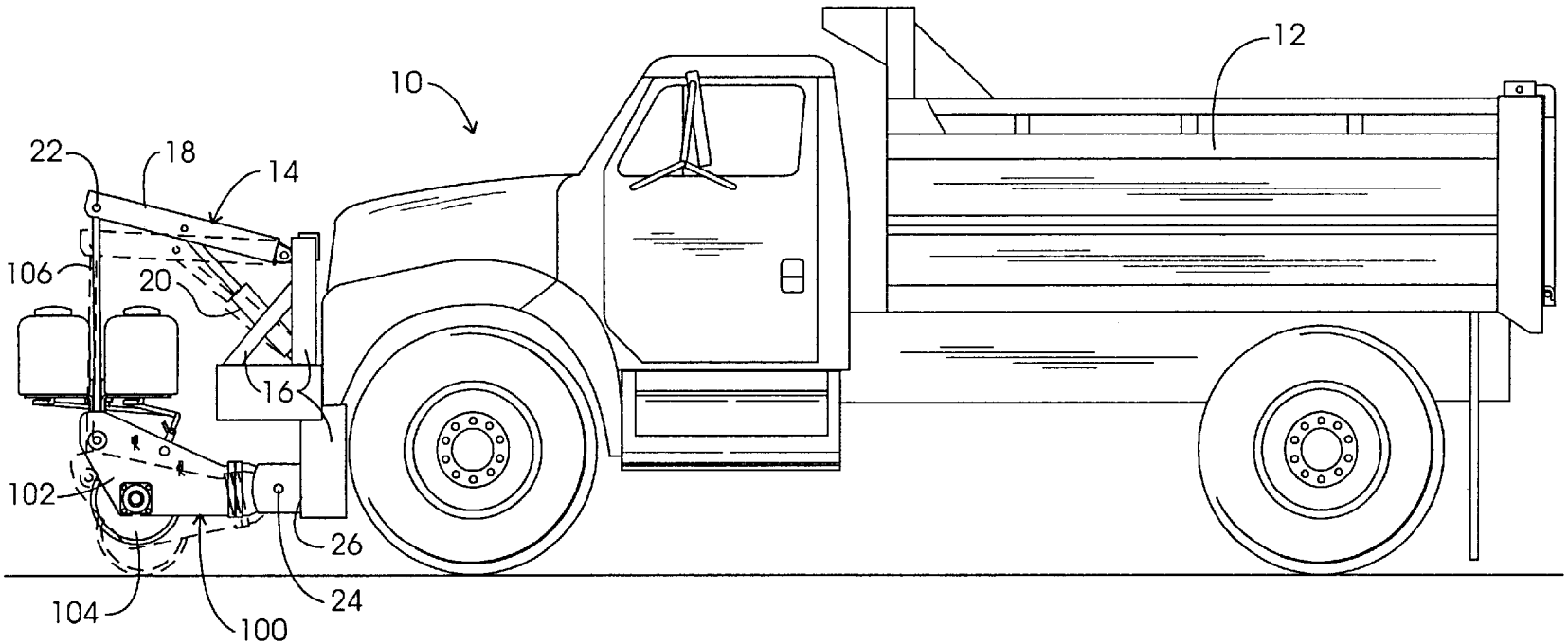
FIG. 1 is a side elevation view of a typical municipal dump truck having a standard three-attach point, front-end, hydraulically-powered snowplow lift, and having a preferred embodiment of the roller assembly of the present invention joined to and carried by the snowplow lift.

FIG. 1 schematically illustrates a conventional truck 10 having a dump bed 12 and a typical front-end, three-point snowplow lift 14 which is mounted on, rigidly secured to, and carried by the truck's vehicular frame. FIG. 1 also illustrates a preferred embodiment of the truck-mounted roller assembly 100 of the present invention attached to and carried by three-point snowplow lift 14. Truck 10 is representative of the type of vehicle that is commonly utilized by municipalities in the United States for roadway snow removal operations, and that often is used for other roadway maintenance purposes, including roadway surface patching with various asphalt materials, after an installed detachable snowplow element has been removed from support and carriage by snowplow lift 14. It should be noted from the drawings that three-point snowplow lift 14 is basically comprised of a multi-piece rigid lift frame 16 which is rigidly secured to the vehicular frame of truck 10, a support arm 18 which is pivotally carried by lift frame 16, and a conventional two-way hydraulic actuator 20 which is pivotally connected to lift frame 16 and to support arm 18. Actuator 20 is normally powered by the truck hydraulic system and conventionally controlled by the truck crew from within the truck cab for the purposes of raising and lowering support arm 18. The three attach points of lift 14 are referenced in the drawings as 22 (on support arm 18) and 24 and 25 on extension 26 of lift frame 16. (See FIG. 2)

Attached roller assembly 100 is basically comprised of a rigid roller frame 102, a hollow cylindrical roller element 104 rotatably supported by and in roller frame 102, a removable tongue member 106 that is pivotally attached to frame 102 by pivot connection 108 and to the support arm 18 of lift 14 at attach point 22, and saddle bracket 110 that is connected to lift 14 at attach point 24 and 25 and to roller frame 102 by a central pivot connection 112. Also included in assembly 100 is a wetting system comprised of optional water reservoirs 114, a water distribution line 116 and shut-off valve 118, and a water distribution spray header 120 which extends the length of cylindrical roller element 104, Reservoirs 114 are supported on platform structures 122 that are rigidly connected to assembly roller frame 102. It should be noted that roller assembly 100 further includes scraper bars 124 and 126 which are pivotally supported at their ends by roller frame 102 and that are rotationally biased toward each other by tension spring 128.

Figure 4:
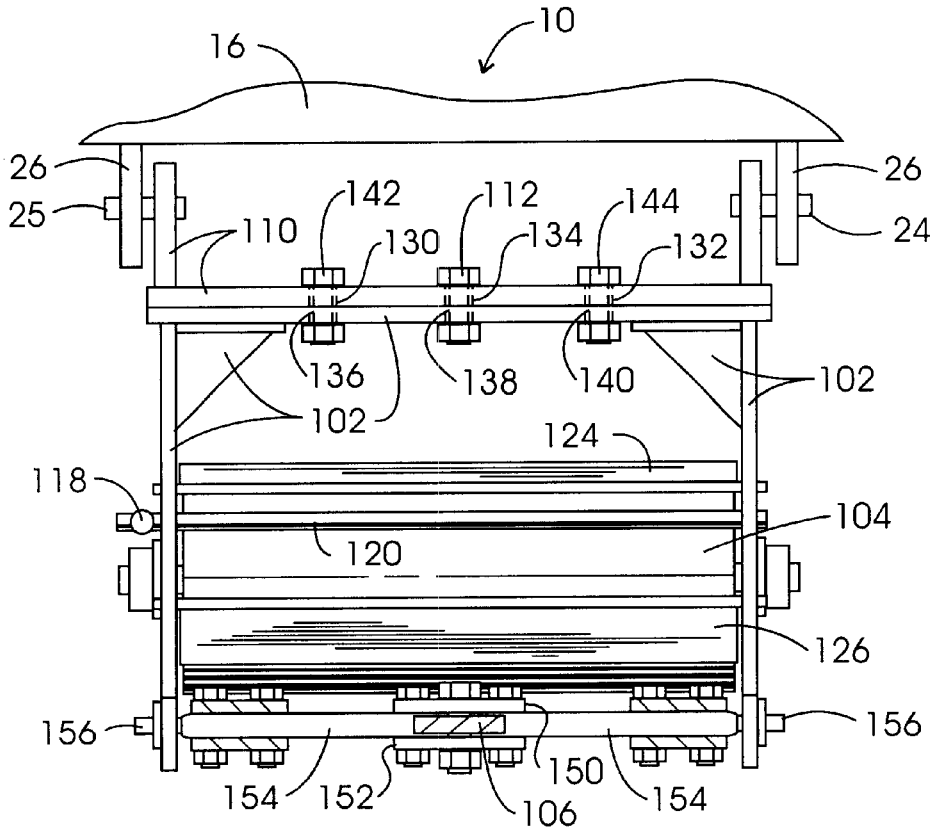
FIG. 4 is plan view taken at line 4—4 of FIG. 2.
Figure 5:
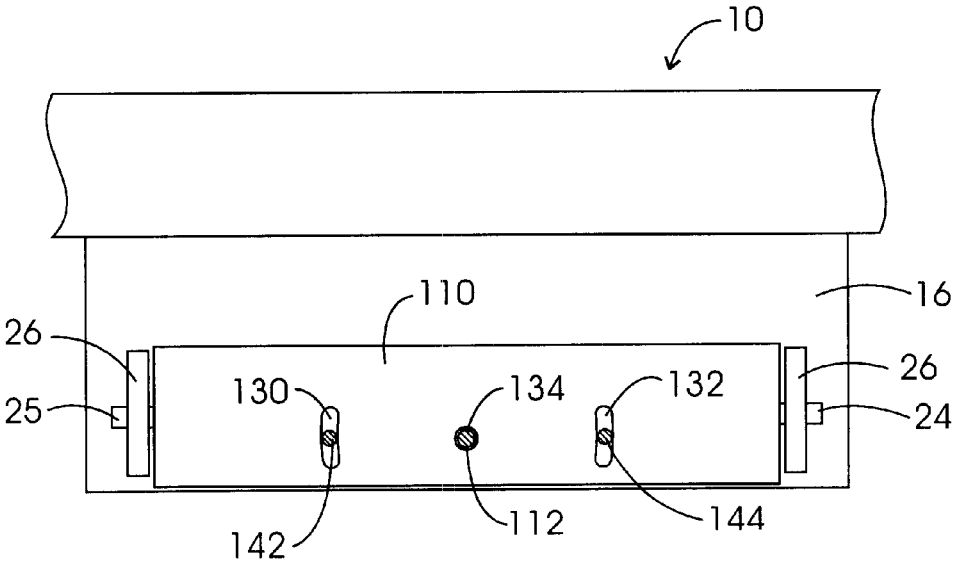
FIG. 5 is a section view taken at line 5—5 of FIG. 3.

Details of saddle bracket 110 and its connections to lift frame 16 of lift 14 and to roller frame 102 of roller assembly 100 are best understood by reference to FIGS. 4 and 5 of the drawings. The central portion of saddle bracket 110 is provided with two longitudinal limit slots 130 and 132 in addition to an opening 134 that receives pivot connection 112. The rear-most element of assembly roller frame element 102 is provided with three openings 136, 138, and 140 (FIG. 4) that register with limit slots 130 and 132, and with pivot connection 112. Threaded bolts 142 and 144 extend through limit slots 130 and 132, respectively, but are not snugged to thereby permit assembly roller frame 102 to have limited rotational movement relative to saddle bracket 110 when roller element 104 is rolled over a roadway surface patching unevenness.

Figure 2:
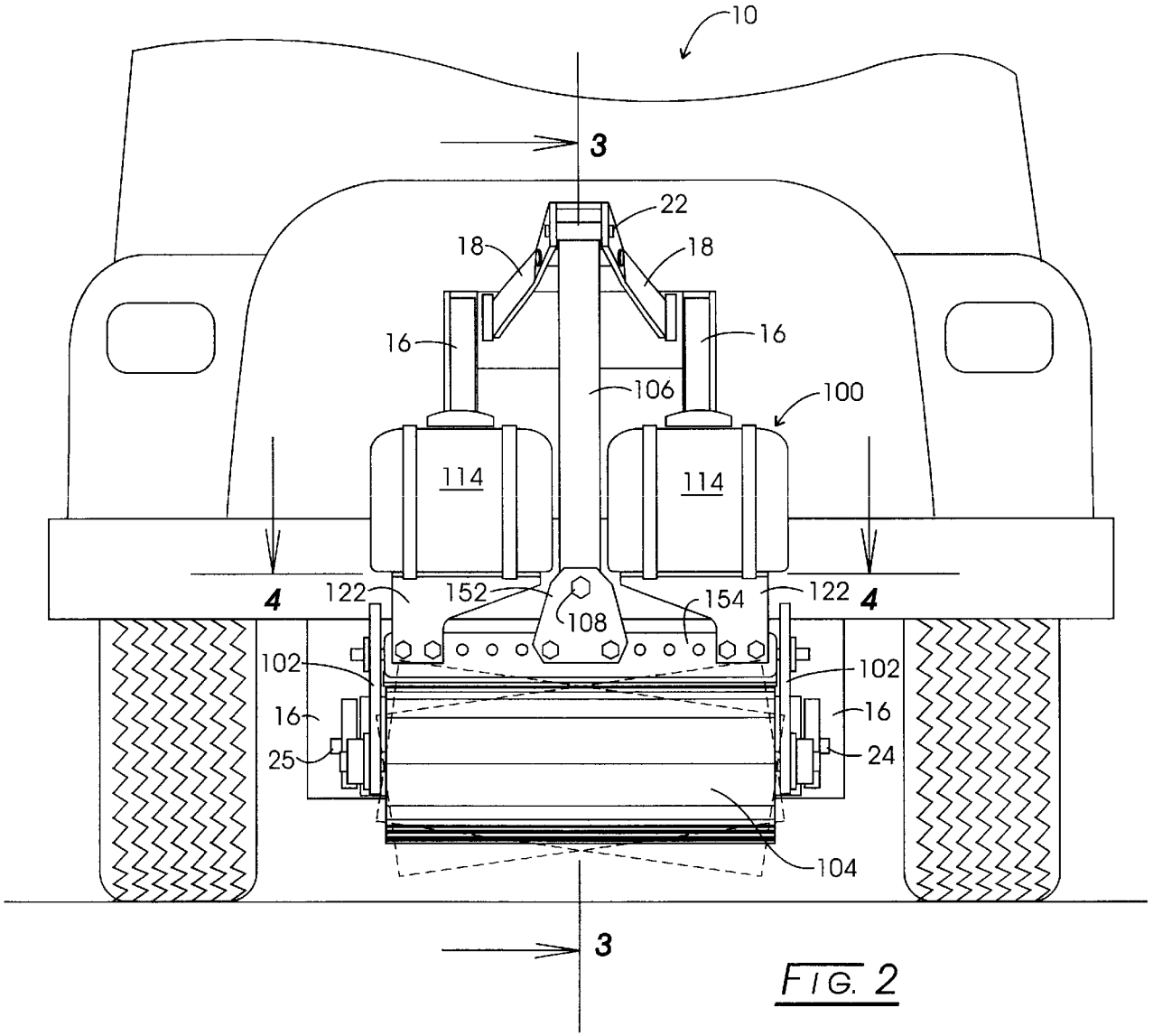
FIG. 2 is front end elevation view of the FIG. 1 apparatus.
Figure 3:
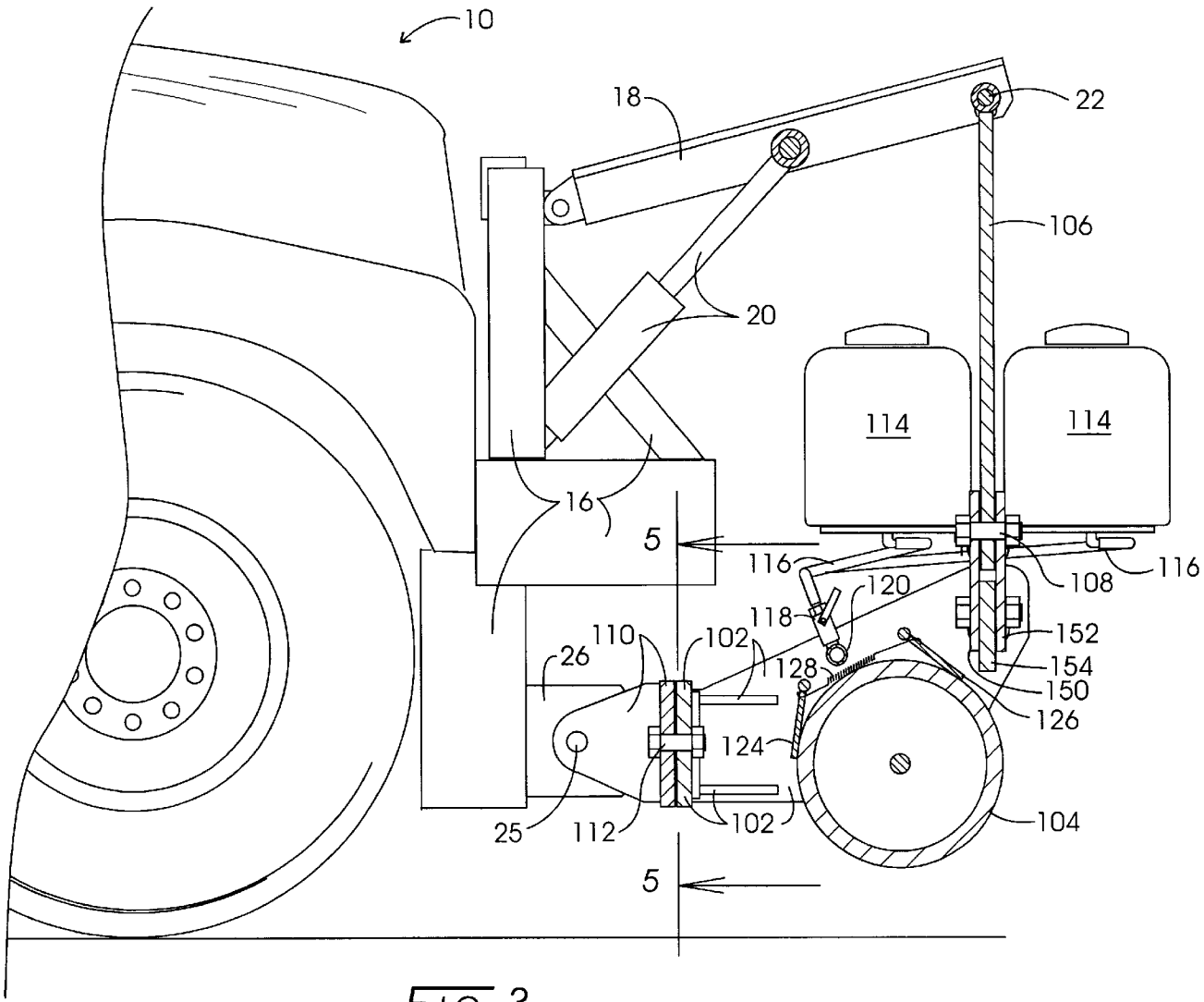
FIG. 3 is a section view taken at line 3—3 of FIG. 2.

FIGS. 2 and 4 illustrate a preferred manner for attaching tongue element 106 to roller frame 102. Two triangularly-shaped plates 150 and 152 are bolted at their lower extremes to cross bar member 154 at opposite sides of tongue member 106 (FIG. 4) and also carry tongue pivot connection 108. Cross bar member 154, in turn, is pivotally connected at each of its ends to roller frame 102 by the pivot connections 156. Thus, as hydraulic actuator 20 is either extended or retracted, tongue member 106 is able to be rotated in fore and aft directions relative to roller frame 102 and roller frame 102 is able to rotate laterally relative to tongue member 106 within the limits of slot elements 130 and 132 and also rotate upwardly and downwardly relative to lift frame attach pivot points 24 and 25. FIG. 1, using dotted lines, illustrates a range through which roller assembly 100 may be moved by operation of hydraulic actuator 20.

Various changes may be made to the shape, size, and operation of the disclosed roller assembly without departing from the scope, meaning, or intent of the claims which follow.

I claim as my invention:

1. A roller assembly adapted to be mounted on a conventional roadway maintenance truck having three standard snowplow attach points comprising:

a rigid open frame;

a roller element rotationally supported at its ends by said rigid open frame;

a rigid tongue member pivotally connected to said rigid open frame for relative rotation in lateral directions, and having a pivot connection to one of the municipal-type snowplow lift standard attach points; and a saddle bracket element pivotally connected to said rigid open frame and having a pair of spaced-apart pivot connections to the other two of the municipal-type snowplow lift standard snowplow attach points, said rigid open frame being rotatable laterally about a horizontal axis relative to said saddle bracket element through a limited range to accommodate changes in roadway surface transverse curvature.

2. The roller assembly invention defined by claim 1, and wherein said rigid tongue member is rotatable in forward and aft directions relative to said rigid open frame in addition to being rotatable in lateral directions.

3. The roller assembly invention defined by claim 1, wherein said saddle bracket element is provided with at least one vertically-oriented limit slot, and wherein said rigid open frame is provided with at least one limit bolt slidably engaged with a respective saddle bracket limit slot, the extremes of said saddle bracket limit slot defining the extent of the range through which said rigid open frame may be rotated relative to said saddle bracket.

4. A roadway maintenance vehicle, comprising:

a truck vehicle capable of transporting roadway surface maintenance materials;

a snowplow lift mounted on said truck vehicle and having a bi-directional hydraulic actuator and three standard snowplow attach points;

a roller assembly rigid open frame;

a roller element supported at its ends by said roller assembly rigid open frame;

a rigid tongue member pivotally connected to said roller assembly rigid open frame for relative rotation in lateral directions, and having a pivot connection to one of said snowplow lift standard snowplow attach points; and a saddle bracket element pivotally connected to said roller assembly rigid open frame and having a pair of spaced-apart pivot connections to the other two of said snowplow lift standard snowplow attach points, said roller assembly rigid open frame being rotatable laterally about a horizontal axis relative to said saddle bracket element through a limited range to accommodate changes in roadway surface transverse curvature, and said snowplow lift bi-directional hydraulic actuator transferring weight from said truck vehicle to said roller element when actuated in one hydraulic actuator bi-directional direction.

5. The roadway maintenance vehicle invention defined by claim 4, and wherein said rigid tongue member is rotatable in forward and aft directions relative to said roller assembly rigid open frame in addition to being rotatable in lateral directions.

6. The roadway maintenance vehicle invention defined by claim 4, wherein said saddle bracket element is provided with at least one vertically-oriented limit slot, and wherein said rigid open frame is provided with at least one limit bolt slidably engaged with a respective saddle bracket limit slot, the extremes of said saddle bracket limit slot defining the extent of the range through which said roller assembly rigid open frame may be rotated relative to said saddle bracket.

* * * * *